US008044862B2

(12) United States Patent
Sim et al.

(10) Patent No.: US 8,044,862 B2
(45) Date of Patent: Oct. 25, 2011

(54) ANTENNA SYSTEM HAVING ELECTROMAGNETIC BANDGAP

(75) Inventors: Dong-Uk Sim, Daejeon (KR); Jong Hwa Kwon, Daejeon (KR); Sang Il Kwak, Daejeon (KR); Hyung Do Choi, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 377 days.

(21) Appl. No.: 12/314,837

(22) Filed: Dec. 17, 2008

(65) Prior Publication Data

US 2009/0201212 A1 Aug. 13, 2009

(30) Foreign Application Priority Data

Dec. 17, 2007 (KR) ..... 10-2007-0132737

(51) Int. Cl.
*H01Q 1/24* (2006.01)

(52) U.S. Cl. ..... 343/700 MS; 343/909

(58) Field of Classification Search ..... 343/785, 343/771, 741, 846, 769, 818, 767, 792.5, 343/795, 786, 715, 841, 770, 713, 756, 702, 343/895, 909, 700 S, 700 MS; 333/21 A, 333/12, 26, 158, 237, 24.2; 257/30, 425, 257/25, 21; 342/44, 368, 372, 28, 458, 353, 342/22, 373, 442, 27, 149, 420; 340/572.4, 340/572.7, 572.3, 447, 572.5, 572.1, 5.62, 340/10.34, 573.3, 552
See application file for complete search history.

(56) References Cited

U.S. PATENT DOCUMENTS

| | | | | |
|---|---|---|---|---|
| 6,483,481 | B1 | 11/2002 | Sievenpiper et al. | |
| 6,518,930 | B2 | 2/2003 | Itoh et al. | |
| 6,768,476 | B2 | 7/2004 | Lilly et al. | |
| 7,142,822 | B2 * | 11/2006 | Tanaka et al. | 455/74 |
| 2003/0122729 | A1 | 7/2003 | Diaz et al. | |
| 2005/0128028 | A1 * | 6/2005 | Sanchez et al. | 333/157 |
| 2005/0243005 | A1 * | 11/2005 | Rafi et al. | 343/767 |
| 2007/0126641 | A1 * | 6/2007 | Saily | 343/700 MS |

FOREIGN PATENT DOCUMENTS

KR 10-2004-0065683 7/2004

OTHER PUBLICATIONS

"Microstrip Antennas Integrated With Electromagnetic Band-Gap (EBG) Structures: A Low Mutual Coupling Design for Array Applications", Fan Yang et al., IEEE Transactions on Antennas and Propagation, vol. 51, No. 10, Oct. 2003.
"Planar Artificial Magnetic Conductors and Patch Antennas", Ying Zhang et al., IEEE Transactions on Antennas and Propagation, vol. 51, No. 10, Oct. 2003.
"A Compact Planar Inverted-F Antenna With a PBG-Type Ground Plane for Mobile Communications", Zhengwei Du et al., IEEE Transactions on Vehicular Technology, vol. 52, No. 3, May 2003.

* cited by examiner

*Primary Examiner* — Tho G Phan
(74) *Attorney, Agent, or Firm* — Rabin & Berdo, P.C.

(57) ABSTRACT

An antenna system includes an antenna transmitting and receiving a signal; a power feeding line feeding electric power to the antenna; and a metal conductor ground electrically connected to the power feeding line. Further, the metal conductor ground includes an electromagnetic bandgap.

16 Claims, 8 Drawing Sheets
(2 of 8 Drawing Sheet(s) Filed in Color)

ANTENNA SYSTEM HAVING ELECTROMAGNETIC BANDGAP

CROSS-REFERENCE TO RELATED APPLICATIONS

The present invention claims priority of Korean Patent Application No. 10-2007-0132737, filed on Dec. 17, 2007, which is incorporated herein by reference.

FIELD OF THE INVENTION

The present invention relates to an antenna system, and more particularly to an antenna system having an electromagnetic bandgap and employed in a base station, a repeater, a satellite tracking antenna, a vehicle antenna, and the like.

This work was supported by the IT R&D program of MIC/IITA [2007-F-043-01, Study on Diagnosis and Protection Technology based on EM].

BACKGROUND OF THE INVENTION

An electromagnetic bandgap can be implemented by periodically arranging desired unit cells on an electric conductor by a preset interval or without the preset interval therebetween, and on the surfaces of arrangements of the unit cells, tangent component of a magnetic field becomes '0' (zero) at a specific band so that an electric current cannot flow on the surfaces of the electromagnetic bandgap. This feature is a concept opposite to that of an electric conductor and is related to a magnetic conductor, and the surfaces of the electromagnetic bandgap, i.e., the surfaces of the arrangements of the unit cells becomes a high impedance surface in view of an electric circuit. Since a feature of a theoretical magnetic conductor, which cannot exist in real situation, is implemented on the surfaces of the electromagnetic bandgap, the theoretical magnetic conductor is known as an artificial magnetic conductor. This structure, in the field of optics, originally coming from photonic bandgap technology invented to prevent an optical wave from advancing at a specific bandwidth in a guided structure, is recently known as an electromagnetic bandgap for a microwave frequency band as a frequency band to which the structure may be applied is becoming more broad, and is chiefly applied to various fields such as an antenna, a filter, a waveguide, and the like.

Since the electromagnetic bandgap is mostly applied to the antenna field, the electromagnetic bandgap can be understood well by an example of an antenna. Generally, in order to radiate electromagnetic waves effectively, an antenna parallel to a ground of an electric conductor requires a distance longer than $\lambda/4$ ($\lambda$ is a wavelength at a resonance frequency) from the ground. When the distance between the antenna and the ground of the electric conductor is shorter than $\lambda/4$, since a surface current is induced on a surface of the ground of the electric conductor in the direction opposite to a current flowing in the antenna, the currents cancel each other so that the antenna cannot radiate electromagnetic waves. However, when the electromagnetic bandgap is applied instead of the ground of the electric conductor, since the surface current can be prevented from flowing on surfaces of the electromagnetic bandgap at a specific bandwidth, the antenna can be operated at a position much nearer than that of the antenna on the electric conductor. Thus, the distance from the ground to the antenna can be reduced so that the antenna can be made small.

Since the electromagnetic bandgap interrupts the surface current at a specific bandwidth, undesired radiation of electromagnetic waves generated from an edge of a finite ground due to the surface current can be reduced. Since the electromagnetic waves radiated from the antenna to the ground side are reflected at the same phase as that of electromagnetic waves directly radiated in the opposite direction by the electromagnetic bandgap, back radiation can be reduced and radiation gain in a main beam direction can be improved.

Since the above-described technical features of the electromagnetic bandgap are mainly applied to planar antennas, the electromagnetic bandgap is recently being widely applied as a solution for a small antenna, and for improving isolation characteristics between antennas and radiation characteristics of the electromagnetic waves.

However, the electromagnetic bandgap is not being applied to a base station antenna, a repeater antenna, a satellite-tracking antenna, a vehicle antenna, and the like, yet.

SUMMARY OF THE INVENTION

In view of the above, the present invention provides an antenna system having an electromagnetic bandgap to which the electromagnetic bandgap is applied to a metal surface that would deteriorate wave radiation efficiency of an antenna so that an overall size of the antenna can be reduced using unique electromagnetic characteristics of the electromagnetic bandgap, and back radiation of the antenna system can be reduced to improve directivity in the main forward radiation direction of the antenna system.

In accordance with an embodiment of the present invention, there is provided an antenna system including: an antenna transmitting and receiving a signal; a power feeding line feeding electric power to the antenna; and a metal conductor ground electrically connected to the power feeding line, wherein the metal conductor ground includes an electromagnetic bandgap.

Preferably, the antenna comprises one of a base station antenna and a repeater antenna.

Preferably, the one of the base station antenna and the repeater antenna comprises a reflector reflecting a signal radiated from the antenna, wherein the reflector includes the electromagnetic bandgap.

Preferably, the base station antenna comprises one of a monopole antenna, a dipole antenna and a patch antenna.

Preferably, the antenna comprises a satellite-tracking antenna.

Preferably, the satellite-tracking antenna comprises one of a film slot antenna and a waveguide slot antenna.

Preferably, the antenna comprises a vehicle antenna.

Preferably, the vehicle antenna comprises one of a monopole antenna and a glass antenna.

Preferably, the electromagnetic bandgap is formed by arranging unit cells.

Preferably, each of the unit cells includes a dielectric formed on the metal conductor ground and a cell pattern of the electromagnetic bandgap formed on the dielectric.

Preferably, the unit cells of the electromagnetic bandgap are periodically arranged to neighbor each other with a preset interval therebetween and to form an overall cell pattern of the electromagnetic bandgap.

It is preferable that each of the unit cells may further comprise a via-hole penetrating through the dielectric and formed between the metal conductor ground and the unit cells of the electromagnetic bandgap.

The base station antenna, the repeater antenna, the satellite-tracking antenna, and the vehicle antenna, respectively having an electromagnetic bandgap, in accordance with the present invention, may exhibit improved performance over the existing antenna system in size, directivity, and radiation efficiency. In the base station antenna, the repeater antenna, and the satellite-tracking antenna, the antenna systems are miniaturized so that costs for manufacturing and installing thereof can be reduced, the back radiation is reduced, and the directivity can be improved in the main beam direction. Since the vehicle antenna has improved radiation characteristics using the electromagnetic bandgap, a system having an improved reception such as a vehicle radio, a navigation system, a television and the like can be implemented.

BRIEF DESCRIPTION OF THE DRAWINGS

The patent or application file contains at least one sheet of drawings executed in color. Copies of this patent or patent application publication with color drawings will be provided by the Office upon request and payment of the necessary fee.

The objects and features of the present invention will become apparent from the following description of embodiment in conjunction with the accompanying drawings, in which:

FIGS. 12A and 12B illustrate cell patterns of unit cells of the electromagnetic bandgap, wherein FIG. 12A illustrates a cell pattern having a via-hole and FIG. 12B illustrates a cell pattern without a via-hole, respectively.

DETAILED DESCRIPTION OF THE EMBODIMENTS

Hereinafter, embodiments of the present invention will be described in detail with reference to the accompanying drawings. In the following description of the present invention, if the detailed description of the already known structure and operation may confuse the subject matter of the present invention, the detailed description thereof will be omitted.

Figure 1:
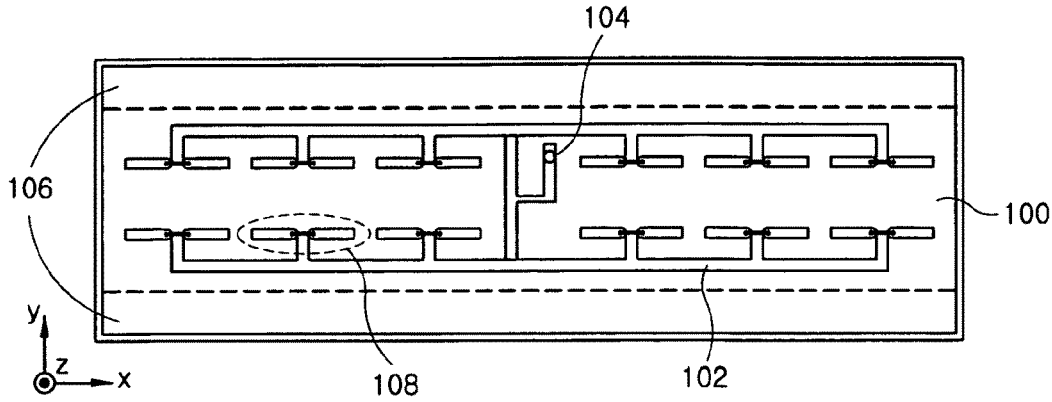
FIGS. 1 to 3 are a plane view, a front view and a side view, respectively illustrating a base station antenna in accordance with an embodiment of the present invention.
Figure 2:
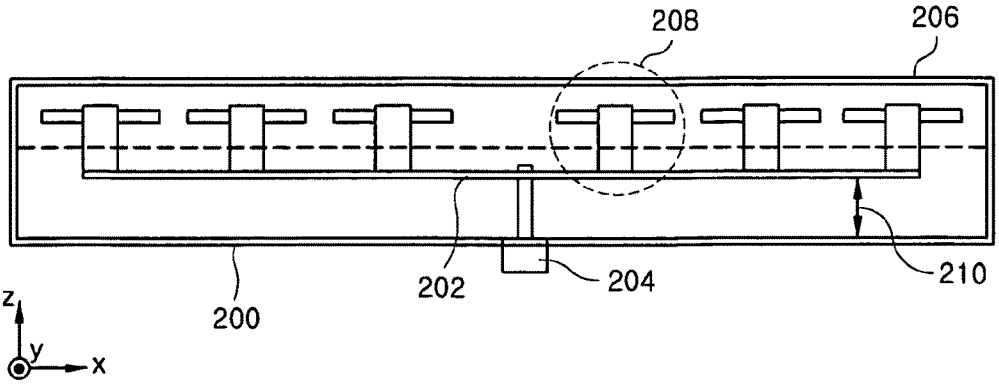
Figure 3:
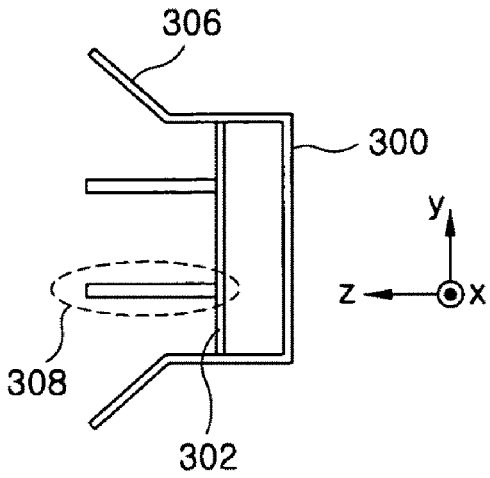

FIGS. 1 to 3 are a plane view, a front view, and a side view respectively illustrating a base station antenna system. As illustrated in FIGS. 1 to 3, the base station antenna system includes dipole antennas 108, 208, and 308 transmitting and receiving an RF signal, power feeding lines 102, 202, 302, feeding electric power to the dipole antennas 108, 208, and 308 and serving as a power distributor, and grounds 100, 200, 300, and 400 of metal conductors electrically connected to the power feeding lines 102, 202, and 302 to ground the dipole antennas 108, 208, and 308. The base station antenna system further includes reflectors 106, 206, and 306 reflecting signals radiated from the dipole antennas 108, 208, and 308. Although, the base station antenna system including the dipole antennas is illustrated in FIGS. 1 to 3, the base station antenna may employ a monopole antenna different from the dipole antennas, a dipole array antenna, a patch array antenna, or all of them.

Figure 4:
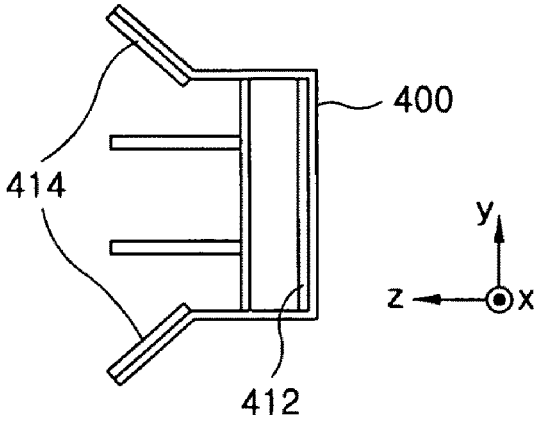
FIG. 4 illustrates the base station antenna of FIG. 3 employing an electromagnetic bandgap in accordance with an embodiment of the present invention.

FIG. 4 illustrates the base station antenna system of FIG. 3 employing an electromagnetic bandgap in accordance with an embodiment of the present invention.

In the base station antenna system in accordance with the embodiment of the present invention, electromagnetic bandgaps 412 and 414 are formed on the grounds 100, 200, 300, and 400 of the metal conductors and the reflectors 106, 206, and 306.

As such, when the electromagnetic bandgaps 412 and 414 are applied to the grounds 100, 200, 300, and 400 of the metal conductors and the reflectors 106, 206, and 306, a height 210 of the antennas from the ground 200 can be reduced so that the overall size of the antenna system can be reduced and the directivity in the main beam direction (Z-direction) can be improved more than in an antenna without the electromagnetic bandgaps 412 and 414.

Figure 5:
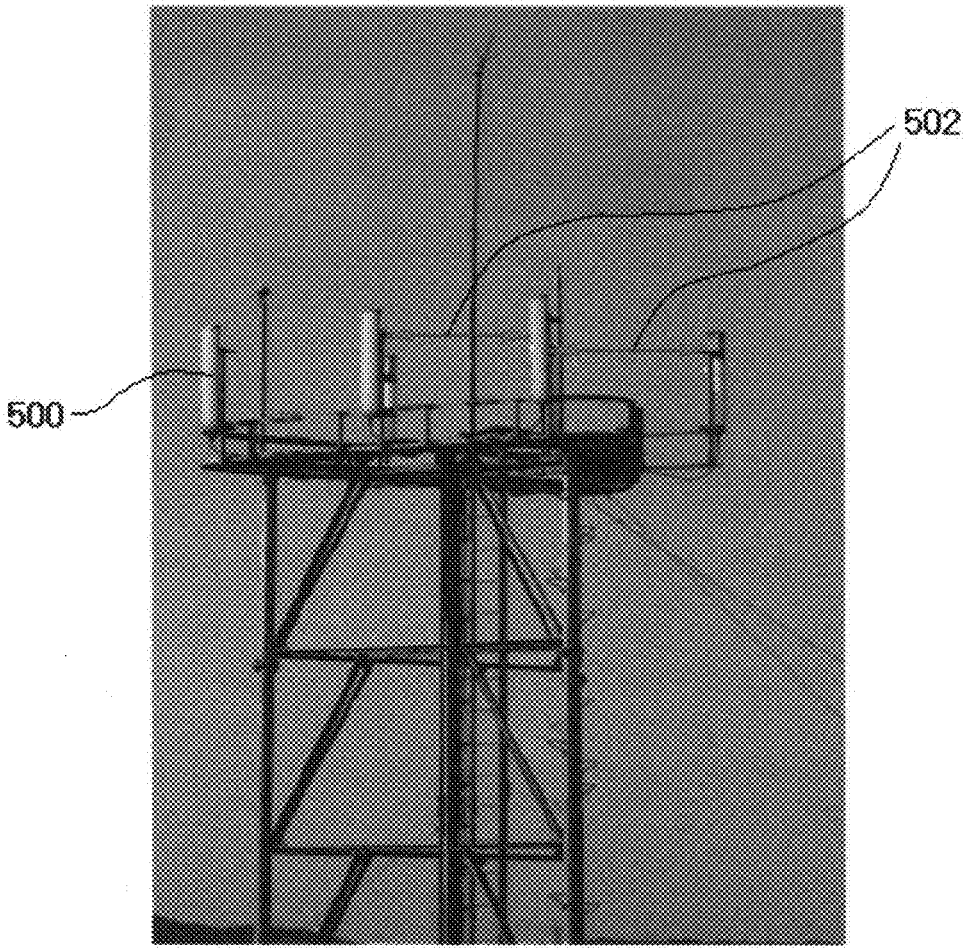
FIG. 5 is view illustrating a commercial base station.

FIG. 5 illustrates a commercial base station system. Referring to FIG. 5, since a distance 502 between antennas 500 must be sufficient in order to avoid coupling between the antennas 500 when the base station is installed, it is ineffective to utilize space and it is disadvantageous in installing costs and maintenance. In the antenna system having the electromagnetic bandgaps 412 and 414 in accordance with the embodiment of the present invention, since a beam pattern is adjusted and back and spatial radiations are reduced to improve the directivity in the main beam direction, the distance 502 between the antennas 500 can be reduced so that it is advantageous to install a base station.

Although FIGS. 1 to 5 illustrate only a base station antenna system, the electromagnetic bandgap may be applied to an indoor and/or outdoor repeater antenna system for supporting communication at a bandwidth narrower than that covered by the base station antenna system in the same manner, and miniaturization and directivity of the antenna system can be improved like in the base station antenna system.

Figure 6:
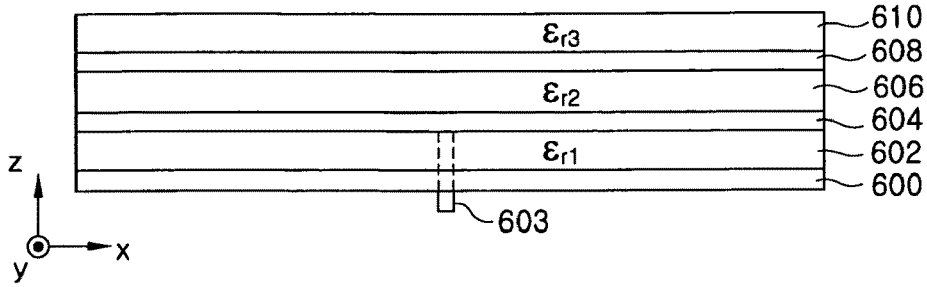
FIG. 6 is a front view illustrating a satellite-tracking antenna.

FIG. 6 is a front view illustrating a satellite-tracking antenna. Commercial satellite-tracking antennas mainly employ a plate-type antenna as illustrated in FIG. 6. The satellite-tracking antenna of FIG. 6 is a film slot antenna and is operated by electric power being fed from power feeding points to a power feeding patch (power distributor 604), as in the case of the base station antenna system.

The satellite-tracking antenna includes a ground 600 of a metal conductor, dielectrics 602, 606, and 610, a power feeding line 603, a power feeding patch 604, and a film slot antenna 608.

The ground 600 of the metal conductor is connected to the power feeding line 603 and the power feeding line 603 feeds an electric power to the film slot antenna 608 on the dielectric 606 via the power feeding patch 604. Consequently, the film slot antenna 608 transmits and receives an RF signal.

For the operation of the film slot antenna 608 on the ground 600 of the metal conductor, the dielectrics 602, 606, and 610 with a predetermined thickness are required. Although dielectric constants of the dielectrics 602, 606, and 610 must be greater than that of air in order to reduce a height (size) of the antenna, since this is not good for the radiation efficiency and bandwidth of the antenna, Styrofoam with a preset thickness and having a dielectric constant near to that of air is employed in most cases.

Figure 7:
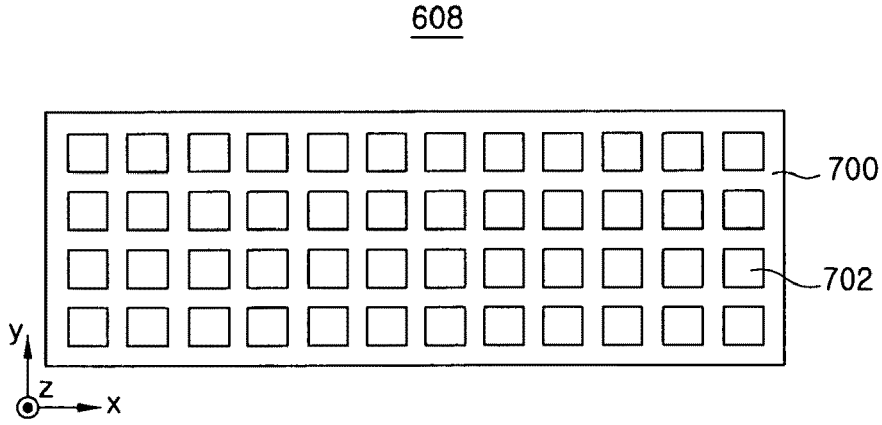
FIG. 7 is a detailed view illustrating the film slot antenna of the satellite-tracking antenna.

FIG. 7 is a detailed view illustrating the film slot antenna 608 of the satellite-tracking antenna. The film slot antenna 608 includes a metal patch 700 and slots 702. Although rectangular slots 702 are depicted in the drawing, this is just an example and the slots 702 may have one of various shapes.

Figure 8:
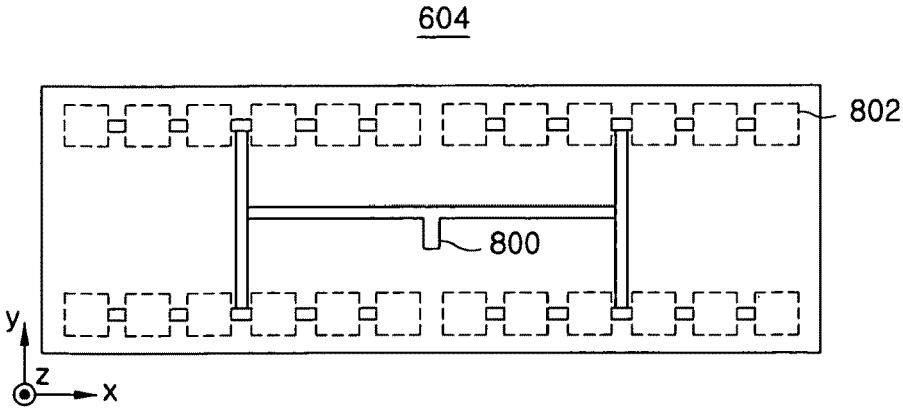
FIG. 8 is a detailed view illustrating a power feeding patch of the satellite-tracking antenna in accordance with an embodiment of the present invention.

FIG. 8 is a detailed view illustrating the power feeding patch 604 of the satellite-tracking antenna in accordance with an embodiment of the present invention. The power feeding patch 604 includes a power feeding point 800 and a power distributor power distribution circuit 802.

Figure 9:
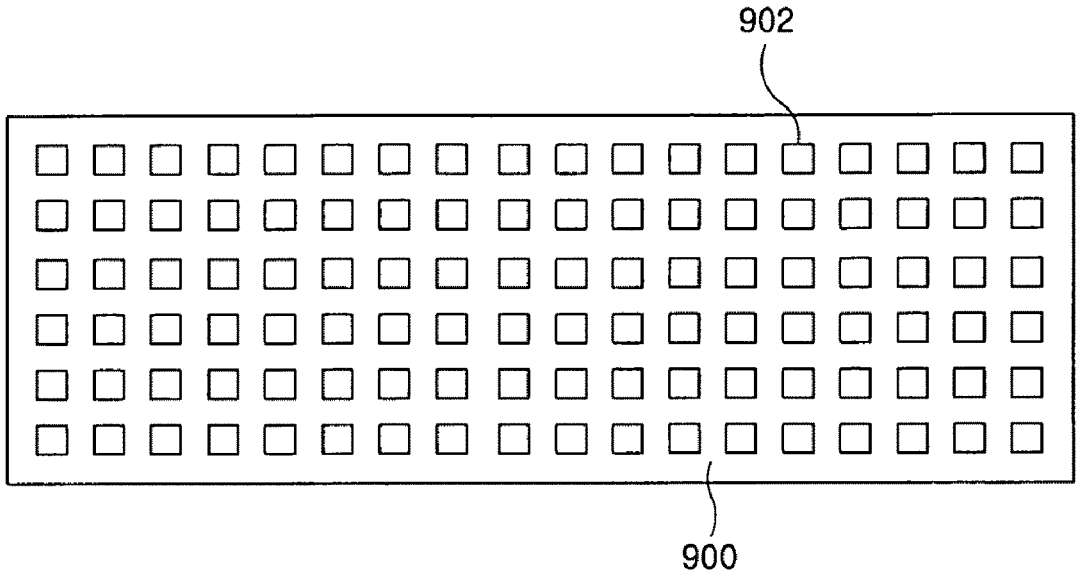
FIG. 9 illustrates an antenna system in which the structure of an electromagnetic bandgap is applied to the satellite-tracking antenna in accordance with the embodiment of the present invention.
Figure 11:
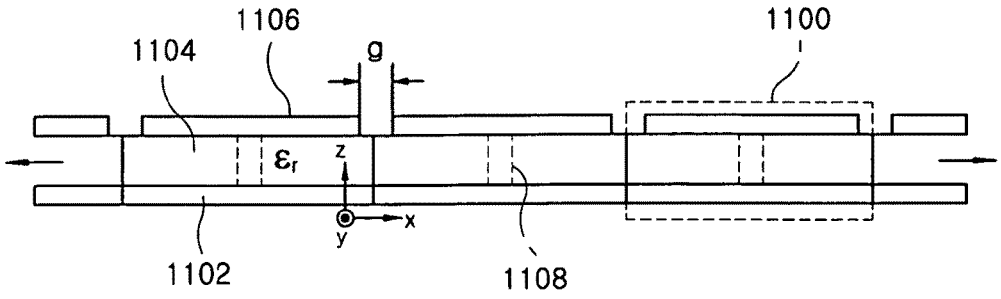
FIG. 11 is a sectional view illustrating an electromagnetic bandgap in accordance with an embodiment of the present invention.

FIG. 9 illustrates an antenna system in which an electromagnetic bandgap is applied to the satellite-tracking antenna in accordance with an embodiment of the present invention. Referring to FIGS. 6 and 9, dielectrics (not shown, represented as a reference numeral 1104 in FIG. 11) are arranged on the grounds 600 and 900 of metal conductors and unit cells 902 of the electromagnetic bandgap are arranged in the form of a matrix with a preset interval on the dielectrics (not shown). The satellite-tracking antenna must have directivity in the main beam direction much better than that of a general antenna. Thus, when the electromagnetic bandgap structure of FIG. 9 having a structure shown in FIG. 11 is applied to the ground 600 of a metal conductor in FIG. 6, the antenna can be miniaturized and the directivity of the antenna can be improved as described with respect to the base station antenna system and the repeater antenna.

Although the satellite-tracking antenna including the film slot antenna is depicted and described, the film slot antenna and a waveguide slot antenna all may used as the satellite-tracking antenna.

Figure 10:
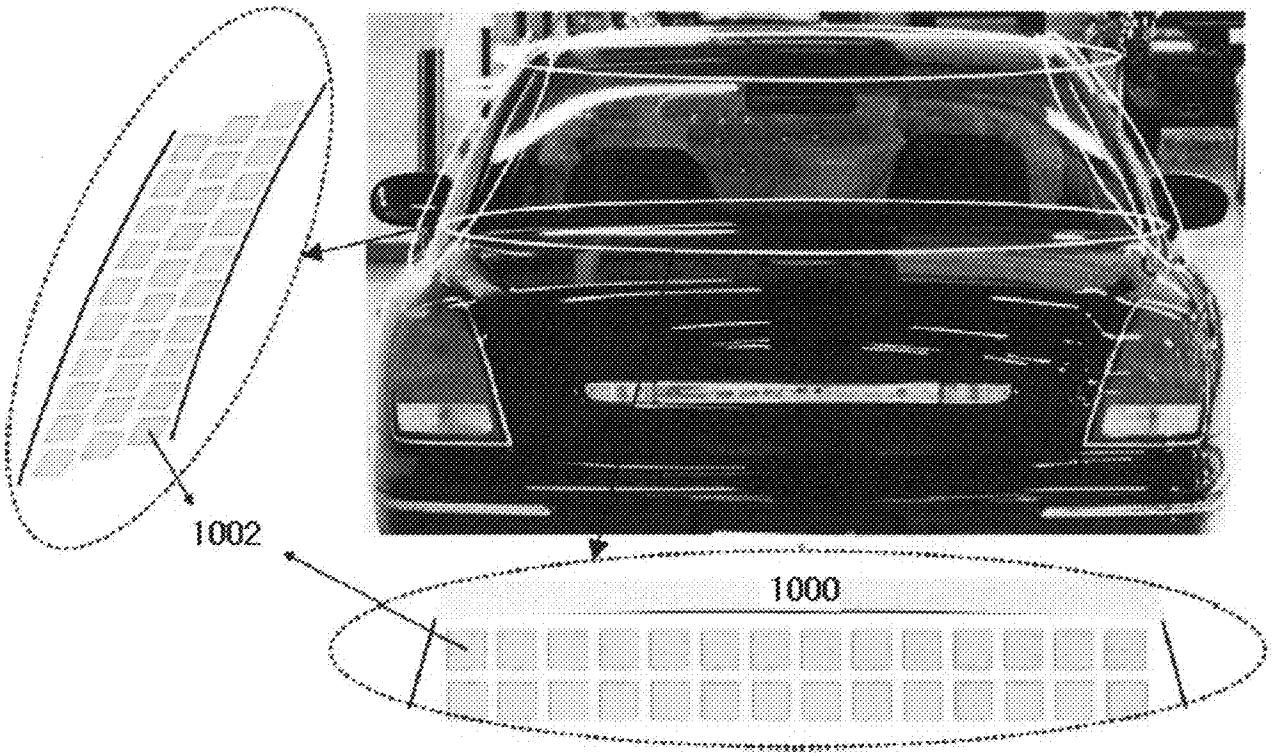
FIG. 10 illustrates an antenna system, in accordance with an embodiment of the present invention, in which an electromagnetic bandgap is applied to metal conductors around a glass antenna of a vehicle.

FIG. 10 illustrates an antenna system, in accordance with an embodiment of the present invention, in which an electromagnetic bandgap structure is applied to metal conductors around a glass antenna of a vehicle. In the antenna system of FIG. 10, cell patterns 1002 of electromagnetic bandgap unit cells are periodically arranged on dielectrics (not shown) formed on metal conductors functioning as an electric conductors of the glass antenna at four sides surrounding a rear glass 1000 of a vehicle. The vehicle glass antenna has a disadvantage that efficiency of the antenna deteriorates due to radial coupling caused by surface current, which is induced in the metal conductors around the rear glass 1000. When the electromagnetic bandgap structure is applied to the metal conductors around the vehicle glass antenna as in a case of this embodiment of the present invention, the surface current is restricted from being generated and the radiation efficiency can be improved.

Although the vehicle antenna including the glass antenna has been depicted and described, the vehicle antenna may include a monopole antenna, a glass antenna, or both of them. Thus, the radiation efficiency of the vehicle antenna can be improved in the same manner as that of the monopole antenna.

FIG. 11 is a sectional view illustrating an electromagnetic bandgap in accordance with an embodiment of the present invention.

As illustrated in FIG. 11, the electromagnetic bandgap is formed by an array of unit cells 1100, wherein each of the unit cells 1100 includes a metal conductor ground 1102, dielectric 1104, and cell patterns 1106. The dielectric 1104 is formed on the metal conductor ground 1102 and the cell patterns 1106 are formed on the dielectric 1104.

The cell patterns 1106 are spaced apart from neighboring cell patterns 1106 in a specific gap g and are periodically arranged.

Each of the unit cells 1100 may further include a via-hole 1108 formed between the metal conductor ground 1102 and the cell patterns 1106 to penetrate the dielectric 1104. The via-holes 1108 are a parameter, related to inductance generated in the unit cells 110, and one of parameters determining an operating frequency band of the unit cells 110.

Figure 12A:
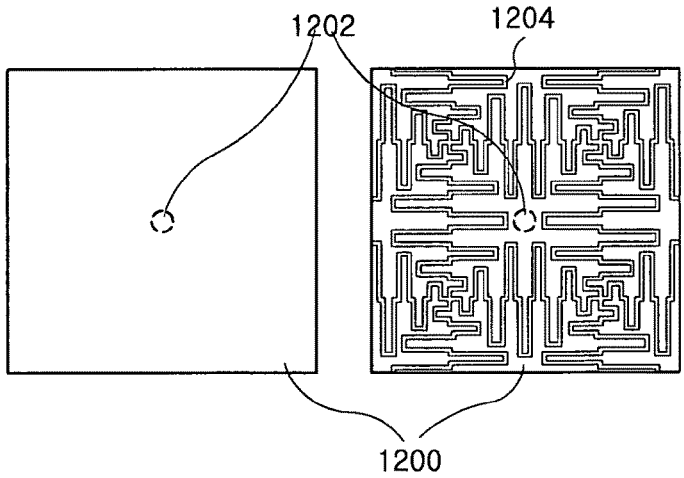
Figure 12B:
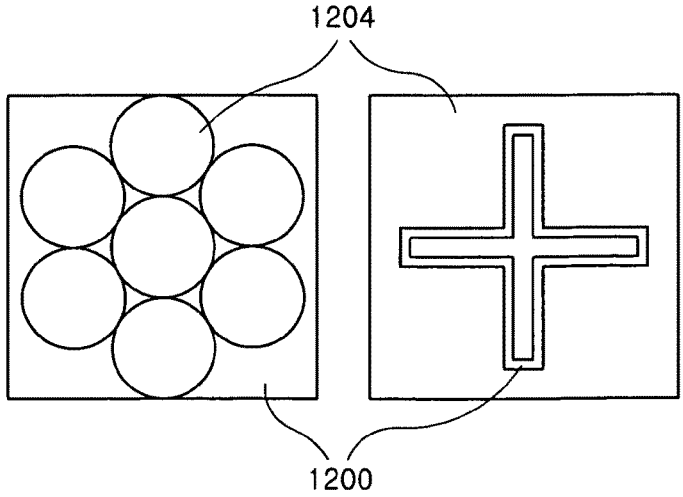

FIGS. 12A and 12B illustrate the cell patterns 1106 of the unit cells 1100, in which: FIG. 12A illustrates a cell pattern having a via-hole; and FIG. 12B illustrates a cell pattern without a via-hole. Referring to FIG. 12A, the cell patterns 1200 made of a metal conductor are formed and a via-hole 1202 is formed at the center of the cell patterns 1200. As illustrated in FIG. 12A, the dielectric 1204 under the cell patterns 1200 is exposed between the cell patterns 1200. Referring to FIG. 12B, the cell pattern 1200 made of a metal conductor is formed and the dielectric 1204 under the metal conductor is exposed, as the case of FIG. 12A. An operating band and bandwidth of the unit cells 1100 are determined by inductance and capacitance occurring due to a size of the cell pattern 1106, a distance between the cell patterns, and a distance between the metal conductor ground 1102 and the cell patterns 1106, which determine an operating band of the electromagnetic bandgap.

Figure 13:
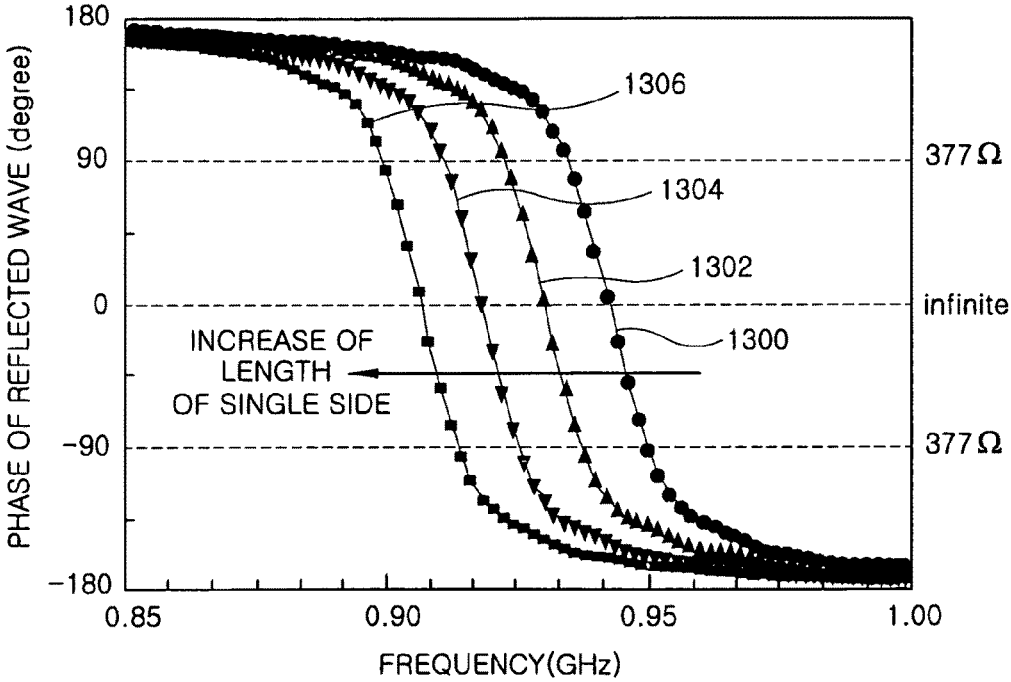
FIG. 13 is a graph illustrating variation of an operating band with respect to the cell size of the unit cell.

FIG. 13 is a graph illustrating variation of an operating band with respect to the cell size of the unit cells. FIG. 13 illustrates variation of the electromagnetic bandgap with respect to change of a length of a single side of a unit cell 1100. In other words, inductance increases as the length of a single side increases such that the operating frequency bands of the unit cells 1100 are lowered (curves 1300, 1302, 1304, and 1306 in FIG. 13). The unit cells 1100 of the electromagnetic bandgap are optimized by a process of designing a pattern with a length and an interval such that the unit cells 1100 are operated at a desired frequency band, of analyzing whether performance is varied due to the electromagnetic coupling with an object to which the unit cells 1100 are applied, and of finely tuning the unit cells 1100 relating to the object for the final performance matching.

While the invention has been shown and described with respect to the embodiment, it will be understood by those skilled in the art that various changes and modifications may be made without departing from the scope of the invention as defined in the following claims.

What is claimed is:

1. An antenna system comprising:

an antenna transmitting and receiving a signal;

a power feeding line feeding electric power to the antenna;

a metal conductor ground electrically connected to the power feeding line; and an electromagnetic bandgap attached to the metal conductor ground, wherein:

the electromagnetic bandgap has a first surface facing the metal conductor ground and a second surface opposite to the first surface; and the antenna is disposed above the second surface of the electromagnetic bandgap and is spaced apart from the second surface of the electromagnetic bandgap.

2. The antenna system of claim 1, wherein the antenna comprises one of a base station antenna and a repeater antenna.

3. The antenna system of claim 2, wherein the one of the base station antenna and the repeater antenna comprises a reflector reflecting a signal radiated from the antenna, wherein the reflector includes the electromagnetic bandgap.

4. The antenna system of claims 3, wherein the electromagnetic bandgap is formed by arranging unit cells.

5. The antenna system of claim 2, wherein the base station antenna comprises one of a monopole antenna, a dipole antenna and a patch antenna.

6. The antenna system of claim 1, wherein the antenna comprises a satellite-tracking antenna.

7. The antenna system of claim 6, wherein the satellite-tracking antenna comprises one of a film slot antenna and a waveguide slot antenna.

8. The antenna system of claim 1, wherein the antenna comprises a vehicle antenna.

9. The antenna system of claim 8, wherein the vehicle antenna comprises one of a monopole antenna and a glass antenna.

10. The antenna system of claims 1, wherein the electromagnetic bandgap is formed by arranging unit cells.

11. The antenna system of claim 10, wherein each of the unit cells comprises:

a dielectric formed on the metal conductor ground; and a cell pattern of the electromagnetic bandgap formed on the dielectric.

12. The antenna system of claim 11, wherein the unit cells of the electromagnetic bandgap are periodically arranged to neighbor each other with a preset interval therebetween and to form an overall cell pattern of the electromagnetic bandgap.

13. The antenna system of claim 11, wherein each of the unit cells further comprises a via-hole penetrating through the dielectric and formed between the metal conductor ground and the unit cells of the electromagnetic bandgap.

14. The antenna system of claim 1, wherein the power feeding line includes a first portion facing the second surface of the electromagnetic bandgap and a second portion opposite to the first portion, and the antenna extends from second portion of the power feeding line in a direction to be spaced gradually further apart from the second portion of the power feeding line.

15. The antenna system of claim 1, wherein the power feeding line includes a power feeding patch that has a first surface facing the second surface of the electromagnetic bandgap and a second surface opposite to the first surface, and the antenna is disposed to face and be spaced apart from the second surface of the power feeding patch.

16. The antenna system of claim 15, wherein the power feeding patch includes a power feeding point and a power distribution circuit.

* * * * *